US009050242B1

(12) United States Patent
Mooney et al.

(10) Patent No.: US 9,050,242 B1
(45) Date of Patent: Jun. 9, 2015

(54) INFANT BOTTLE WITH FORMULA DISPENSING MEANS

(76) Inventors: Gillian Mooney, Montauk, NY (US); Brian Mooney, Montauk, NY (US)

( * ) Notice: Subject to any disclaimer, the term of this patent is extended or adjusted under 35 U.S.C. 154(b) by 705 days.

(21) Appl. No.: 13/293,819

(22) Filed: Nov. 10, 2011

Related U.S. Application Data

(60) Provisional application No. 61/411,945, filed on Nov. 10, 2010.

(51) Int. Cl.
*A61J 9/08* (2006.01)

(52) U.S. Cl.
CPC ..... *A61J 9/08* (2013.01)

(58) Field of Classification Search
CPC ..... A61J 9/08; A61J 9/085; A61J 9/00
USPC ..... 215/11.6, 11.1, DIG. 8, 227, 228; 220/212, 256, 256.1, 521, 525; 222/129, 566, 567, 568
See application file for complete search history.

(56) References Cited

U.S. PATENT DOCUMENTS

| | | | | |
|---|---|---|---|---|
| 3,468,445 | A | 9/1969 | Ballin | |
| 5,361,918 | A * | 11/1994 | Mason | 215/6 |
| 5,419,445 | A | 5/1995 | Kaesemeyer | |
| 5,433,328 | A | 7/1995 | Baron et al. | |
| 5,638,968 | A | 6/1997 | Baron et al. | |
| D390,964 | S | 2/1998 | Mercer et al. | |
| 5,878,898 | A * | 3/1999 | Shefflin | 215/11.6 |
| 6,045,254 | A | 4/2000 | Inbar et al. | |
| 6,113,257 | A | 9/2000 | Sharon et al. | |
| 2006/0113271 | A1* | 6/2006 | Rea | 215/11.6 |
| 2008/0210656 | A1* | 9/2008 | Mensah-Ouvor et al. | 215/11.6 |
| 2009/0039050 | A1* | 2/2009 | Rea et al. | 215/11.6 |
| 2011/0024537 | A1* | 2/2011 | Gonzalez | 241/101.2 |

* cited by examiner

*Primary Examiner* — Robert J Hicks
*Assistant Examiner* — Kareen Rush
(74) *Attorney, Agent, or Firm* — Robert C. Montgomery; Montgomery Patent & Design, LP.

(57) ABSTRACT

An infant bottle cap provides a means for storing powdered infant formula which is then installed upon a conventional baby bottle. The device comprises a cap attachment which attaches to the bottle and an internal cavity which separates the nipple from the powdered formula. The cap attachment is hollow, allowing for the storage of formula inside said cap. The top surface of the cap further comprises a hinged and latching lid for filling the cap with powdered formula and pouring the formula into water within the bottle when ready for use.

14 Claims, 2 Drawing Sheets

INFANT BOTTLE WITH FORMULA DISPENSING MEANS

RELATED APPLICATIONS

The present invention was first described in and claims the benefit of U.S. Provisional Application No. 61/411,945 filed on Nov. 10, 2010, the entire disclosures of which are incorporated herein by reference.

FIELD OF THE INVENTION

The present invention relates generally to an infant bottle cap, and in particular, to a cap which provides storage capabilities.

BACKGROUND OF THE INVENTION

Infant feeding bottles are known. When an infant is bottle fed a powered formula is added to a bottle filled with water to make a meal for the infant. Preparation of the bottle for infants using the formula takes time and is inconvenient to make. Measuring the formula to the exact amount the infant needs and then mixing it in bottle is problematic when in a rushed situation. Also retaining various containers to make a bottle takes up space in cars, diaper bags, or the like.

Various attempts have been made to provide an infant feeding bottle which provides a compartment to retain a pre-measured amount of formula. Examples of these attempts can be seen by reference to several U.S. patents. U.S. Pat. No. 3,468,445, issued in the name of Ballin, describes an infant feeding container with an integral sealing means.

U.S. Pat. No. 5,419,445, issued in the name of Kaesemeyer, describes an infant bottle with storing and dispensing means.

U.S. Pat. No. 5,433,328, issued in the name of Baron et al., describes an extension to infant bottles which provides storage and releasing of formula.

While these devices fulfill their respective, particular objectives, each of these references suffer from one (1) or more disadvantages. Many are not suited to provide a single compartment for storage. Others are bulky and take up needed space.

SUMMARY OF THE INVENTION

The inventor has recognized the aforementioned inherent problems and lack in the art and observed that there is a need for a bottle cap which provides storage for formula and is adaptable to bottles.

Accordingly, it is an object of the present embodiments of the invention to solve at least one (1) of these problems. The inventor has addressed this need by developing a bottle cap which provides storage and attachment onto infant bottles.

To achieve the above objectives, it is an object of the present invention to provide a cap portion to attach to bottles and store formula.

Another object of the present invention is to provide a collar portion for attachment onto bottles.

Yet still another object of the present invention is to store a desired amount of formula within an internal space.

Yet still another object of the present invention is to provide the cap with a hinged lid.

Yet still another object of the present invention is to provide a method of utilizing the device that provides a unique means of threading the collar onto the bottle, attaching the cap onto the collar, opening the lid and filling the internal portion of the cap with formula.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
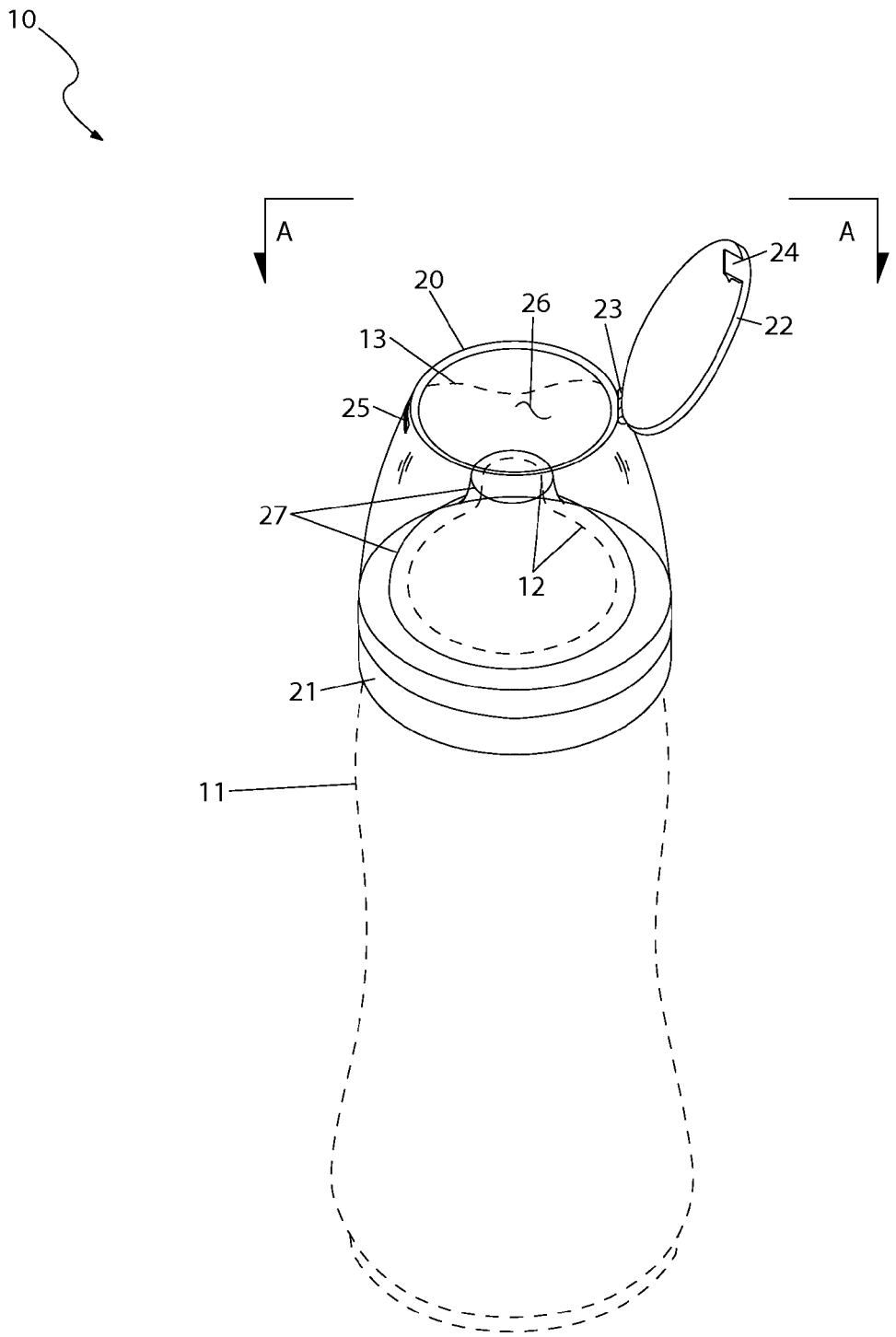
FIG. 1 is a perspective view of an infant bottle cap with formula dispensing means 10, according to a preferred embodiment of the present invention; and, FIG. 2 is a section view of the infant bottle cap with formula dispensing means 10 taken along section line A-A (see FIG. 1), according to a preferred embodiment of the present invention.

10 infant bottle cap with formula dispensing means
11 infant bottle
12 nipple
13 powdered formula
14 bottle threaded region
20 cap
21 collar
22 lid
23 hinge
24 clasp feature
25 retainer feature
26 internal space
27 inner wall
28 top opening
29 water
30 collar threaded region

DETAILED DESCRIPTION OF THE PREFERRED EMBODIMENT

Figure 2:
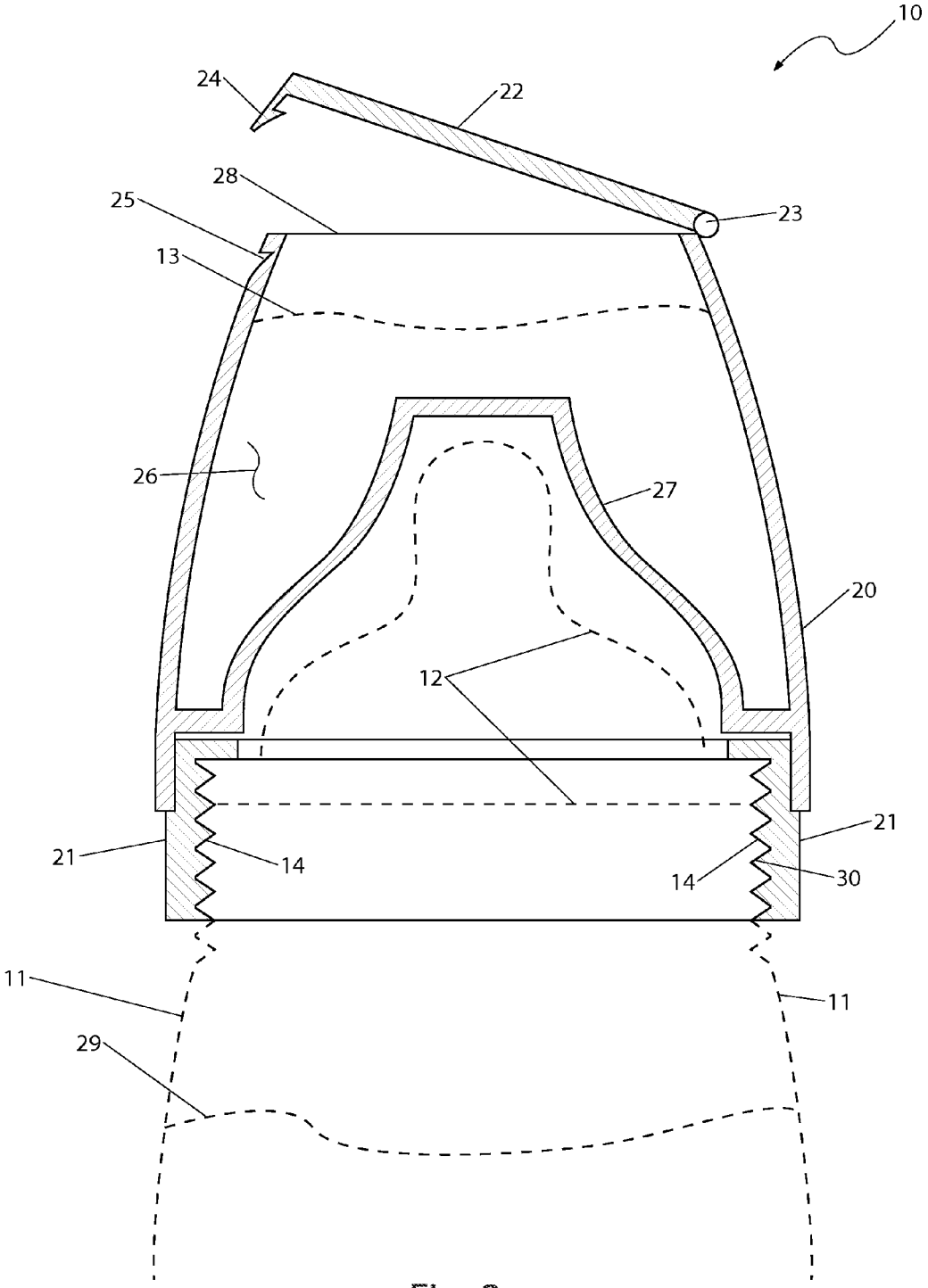

The best mode for carrying out the invention is presented in terms of its preferred embodiment, herein depicted within FIGS. 1 and 2. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Referring now to FIG. 1, a perspective view of the infant bottle cap with formula dispensing means (herein described as the "device") 10, according to the preferred embodiment of the present invention, is disclosed. The device 10 provides a cap portion 20 for attachment to an existing infant bottle 11 being capable of storing a volume of powdered formula 13. The device 10 is attached to said existing infant bottle 11 via a threaded collar portion 21, thereby enabling a caregiver to conveniently mix said powdered formula 13 with water 29 contained within the infant bottle 11 for an infant or child. The device 10 preferably stores enough powdered formula 13 to make an eight (8) ounce bottle of mixed formula; however, other sizes of caps 20 may utilize the teachings of the device 10, and as such should not be interpreted as a limiting factor of the device 10. Furthermore, the threaded collar portion 21 of the device 10 is envisioned to be introduced in various diameters being compatible with different brands of infant bottles 11.

Referring now to FIG. 2, a section view of the device 10 taken along section line A-A (see FIG. 1), according to the preferred embodiment of the present invention, is disclosed. The device comprises a cap 20, a collar 21, and a lid 22, which are preferably fabricated using a Bisphenol A (BPA)-free transparent plastic material to enable the caregiver to view an internal space 26 within the cap 20 which retains the powered formula 13. The cap 20 comprises an upwardly-tapering cup-shaped form being affixed to the subjacent cylindrical collar 21 via a securing interference fit. Said collar 21 further comprises a bottom female collar threaded region 30 which in turn provides a threaded attachment means to a corresponding bottle threaded region 14 of the infant bottle 11. As the collar 21 threadingly engages said bottle threaded region 14, a flange portion of the nipple 12 is compressed and sealed against the bottle 11 in a conventional manner.

Said cap 20 further comprises an integral inner wall portion 27 comprising a shape which parallels a profile of a nipple portion 12 of the infant bottle 11, thereby encompassing and separating said nipple 12 from the powdered formula 13 within the internal space 26.

An upper portion of the cap 20 comprises a circular horizontal top opening 28 and a corresponding lid portion 22 which provides selective access to the internal space 26 of the cap 20. The lid 22 is pivotingly attached to an upper perimeter edge of said top opening 28 via an axial hinge 23 having respective integrally-molded elements. The lid 22 comprises a downwardly protruding and integrally-molded hook-shaped clasp feature 24 which allows access to the powdered formula 13 within or may be secured to close the top opening 28 via engagement of said clasp feature 24 with a correspondingly positioned retainer feature 25 being integrally-molded along an edge of said top opening 28. With the lid 22 in an upright position, the internal space 26 may be filled with powdered formula 13.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIG. 1.

The method of preparing the device 10 for use may be achieved by performing the following steps: procuring the device 10; positioning the nipple portion 12 of the infant bottle 11 onto the bottle threaded region 14; threadingly engaging the collar 31 onto said bottle threaded region 14 of the bottle 11, thereby positioning and sealing the nipple 12 within the inner wall 27; disengaging the clasp feature 24 from the retainer feature 25 and pivoting the lid 22 upwardly about the hinge 23; filling the internal space 26 within the cap 20 with powdered formula 13; and, replacing the lid 22 by engaging said clasp 24 and retainer 25 features. The device 10 is now ready to be used in preparation and feeding of mixed formula to the infant.

The method of utilizing the device 10 to feed an infant may be achieved by performing the following steps: removing the device 10 from the infant bottle 11 by threadingly removing the collar 21 from the bottle threaded region portion 14 of the infant bottle 11; removing the nipple 12 from the infant bottle 11; disengaging the clasp feature 24 from the retainer feature 25 and pivoting the lid 22 upwardly; dispensing the powdered formula 13 from the internal space 26 into a volume of water 29 contained within the infant bottle 20; closing the lid 22 by engaging said clasp 24 and retainer 25 features; replacing the nipple 12 and collar 21 portions onto the infant bottle 11 until tightened; shaking said infant bottle 11 to mix the powdered formula 13 and water 29 in a conventional manner; forcing the cap 20 off the collar 21 to expose the nipple 12; utilizing the device 10 to feed an infant in a normal manner; disassembling and cleaning the device 10; and, providing a quick means of preparing an infant bottle 11 by utilizing the present invention 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. An infant bottle cap, comprising:

a cap body, comprising an open upper portion, a lid removably covering said open upper portion with a lid securing means, an interior wall comprising an upwardly-tapering shape, and an interior; and, a collar, having an upper end removably attached to said cap body, a lower end, and a central aperture;

wherein said lid securing means secures a first side of said lid to a first end of a perimeter edge of said cap body upper portion;

wherein said lid and said cap body are a unitary construction, such that a second side of said lid and a second end of a perimeter edge of said cap body upper portion comprise an integral hinge;

wherein said collar lower end is adapted to be removably attached to an infant bottle opening;

wherein said collar aperture permits the passage of an upper portion of a nipple;

wherein said interior wall permits clearance of said nipple when said collar is attached on said infant bottle opening having said nipple thereon and said cap body is attached to said collar;

wherein said collar provides a fluid seal to said infant bottle opening and said nipple; and, wherein said cap body interior is adapted to receive an amount of formula therein.

2. The bottle cap of claim 1, wherein said lid securing means further comprises:

a downwardly protruding and integrally-molded clasp feature located on said first side of said lid;

a retainer feature located on said first end of an exterior surface of said cap body upper portion;

wherein said retainer feature is correspondingly sized to receive said clasp feature to secure said lid to said cap body.

3. The bottle cap of claim 1, wherein said cap body is removably attached to said collar via an interference fit.

4. The bottle cap of claim 1, wherein said collar lower end further comprises internal threads.

5. The bottle cap of claim 1, wherein said collar lower end is capable of being formed in various different diameters adapted for removable attachment to various sizes of infant bottle openings.

6. The bottle cap of claim 1, wherein said cap body and said collar comprise a BPA-free transparent plastic material.

7. The bottle cap of claim 1, wherein said cap body interior comprises a capacity enabling enough formula to produce an eight-ounce bottle of mixed formula.

8. An infant bottle and bottle cap, comprising:

a cap body, comprising an open upper portion, a lid removably covering said open upper portion with a lid securing means, an interior wall comprising an upwardly-tapering shape, and an interior;

an infant bottle, comprising a beverage container having an upper opening in fluid communication with an interior;

a nipple removably placed on top of said infant bottle upper opening and in fluid communication therewith; and, a collar, having an upper end removably attached to said cap body, a lower end, and a central aperture;

wherein said lid securing means secures a first side of said lid to a first end of a perimeter edge of said cap body upper portion;

wherein said lid and said cap body are a unitary construction, such that a second side of said lid and a second end of a perimeter edge of said cap body upper portion comprise an integral hinge;

wherein said interior wall permits clearance of said nipple when said collar is attached on said infant bottle upper opening having said nipple thereon and said cap body is attached to said collar;

wherein said collar lower end is adapted to be removably attached to said infant bottle upper opening;

wherein said collar aperture permits the passage of an upper portion of a nipple;

wherein said collar provides a fluid seal to said infant bottle upper opening and said nipple; and, wherein said cap body interior is adapted to receive an amount of formula therein.

9. The bottle cap of claim 8, wherein said lid securing means further comprises:

a downwardly protruding and integrally-molded clasp feature located on said first side of said lid;

a retainer feature located on said first end of an exterior surface of said cap body upper portion;

wherein said retainer feature is correspondingly sized to receive said clasp feature to secure said lid to said cap body.

10. The bottle cap of claim 8, wherein said cap body is removably attached to said collar via an interference fit.

11. The bottle cap of claim 8, wherein said collar lower end further comprises internal threads.

12. The bottle cap of claim 8, wherein said collar lower end is capable of being formed in various different diameters adapted for removable attachment to various sizes of infant bottle upper openings.

13. The bottle cap of claim 8, wherein said cap body and said collar comprise a BPA-free transparent plastic material.

14. The bottle cap of claim 8, wherein said cap body interior comprises a capacity enabling enough formula to produce an eight-ounce bottle of mixed formula.

* * * * *